United States Patent [19]

Sasaki

[11] Patent Number: 4,972,585

[45] Date of Patent: Nov. 27, 1990

[54] ROTARY BLADE CUTTER

[76] Inventor: Yutaka Sasaki, 3435-19th S., Seattle, Wash. 98144

[21] Appl. No.: 379,996

[22] Filed: Jul. 14, 1989

[51] Int. Cl.[5] ..... B26B 13/00

[52] U.S. Cl. ..... 30/240; 30/263; 30/314; 30/297; 30/301

[58] Field of Search ..... 30/240, 263, 314, 299, 30/301; 128/305

[56] References Cited

U.S. PATENT DOCUMENTS 2,894,324 7/1959 Hardin ..... 30/240

4,649,919 3/1987 Thimsen et al. ..... 30/240 X

*Primary Examiner*—Douglas D. Watts

*Assistant Examiner*—Willmon Fridie

*Attorney, Agent, or Firm*—Christensen, O'Connor, Johnson & Kindness

[57] ABSTRACT

A rotary blade cutter (10) including a semitubular rotary cutting blade (12) rotatably mounted within a tubular housing (14). The tubular housing 14 includes an entrance slit (22) and a diametrically opposed exit slit (24) for insertion of a web into the cutting device. A first cutting edge (32) is formed along a first side of the entrance slit. The semitubular rotary cutting blade includes a first slit (36) nominally aligned with the housing entrance slit when the rotary blade is in a retracted position, and includes a second cutting edge (48) that is formed adjacent a second side (46) of the entrance slit to oppose the first cutting edge. The second cutting edge is tapered to spiral around the longitudinal axis of the housing. The rotary cutting blade includes a spiral groove (50) that coacts with a guide pin (52) projecting inwardly from the housing to constrain the rotary cutting blade to rotate about the longitudinal axis of the housing when the rotary blade is longitudinally advanced within the housing. As the cutting blade rotates, the second cutting edge moves progressively past the first cutting edge to cut the web inserted therebetween.

15 Claims, 2 Drawing Sheets

ROTARY BLADE CUTTER

BACKGROUND OF THE INVENTION

The present invention relates to a device for cutting a web, more particularly, to a cutting device utilizing a semitubular, or partially tubular, rotary cutting blade, and even more particularly to a hand-held scissors utilizing a semitubular rotary cutting blade.

Conventional cutting devices exist in a variety of forms designed for cutting relatively thin webbing such as paper, cloth, plastic sheeting, or metal foils. Generally, these devices utilize a pair of blades that progressively pass over each other to cut web inserted therebetween. Typically, both blades are flat and define cutting edges that can be straight or curved, with the contour of the two cutting edges corresponding fairly closely. The two blades are typically secured to each other in one of two configurations to accomplish a progressive cut.

In the first configuration, the two blades pivotally joined together. One example of this first configuration exists in conventional hand-held scissors, in which the blades are pivotally secured together intermediate their ends. The blades have opposing cutting ends and opposing loop-shaped handle end. When the handle ends are pressed together, the blades gradually pass over each other to cut a web inserted therebetween. However, this design results in the cutting force decreasing as the cut progresses due to the loss of leverage as the handle ends are drawn together, i.e., the location of the cut moves further away from the pivot point of the blades, making it difficult to complete a cut through thicker webbing.

Another example of this first lever type cutting device configuration is found in standard table mounted paper cutters. A first cutting edge is secured along one side of a flat base, and a second cutting edge is secrued to a lever that is in turn pivotally secured to the base adjacent the first cutting edge. The lever is depressed downwardly towards the base to cause the second cutting edge to gradually pass over the first cutting edge, cutting a web inserted therebetween. This example again exhibits a reduction of cutting force as the cut progresses.

The second conventional cutting device configuration involves the slidable mounting of a movable blade spaced away from and parallel to a first stationary blade, such as in a guillotine-type cutting device. In such a device, the stationary blade is secured along one edge of a base, and the movable blade is slidably secured directly above and parallel to the stationary blade. Typically, the cutting edge on the movable blade is angled with respect to the cutting edge of the stationary blade. When the movable blade is lowered towards the base, the movable cutting edge passes progressively over the stationary cutting edge. This type of device results in a cut being made with uniform cutting force the width of the web, overcoming the limitation of lever type cutters. However, the device is more complex than lever type cutters, increasing the expense of its manufacture, and making it cumbersome for use as a hand-held device. In addition, the parallel opposed facing of the blades does not result in the increased leverage occasioned by lever-type devices, requiring a greater force to cut a given piece of webbing.

An additional limitation of the above-described conventional cutting devices is the exposure of the stationary and movable cutting blades, resulting in a safety hazard should the cutting blades slip relative to the web or a user's fingers happen to be inserted between the blades during cutting.

SUMMARY OF THE INVENTION

The present invention is directed at a cutting device that utilizes a rotary cutting blade, formed in a partially tubular, or semitubular, configuration with a discontinuous outer wall, that moves progressively past a stationary cutting edge to cut a web inserted therebetween, resulting in both the progressive cutting of the web and a constant cutting force during that progressive cut. In a preferred embodiment of the present invention in the form of a hand-held scissors, the semitubular cutting blade is mounted within a tubular housing. The tubular housing includes a longitudinal, elongated entrance slit and a diametrically opposed exit slit with a web being insertable through the slits. The slits extend from an open first end of the housing partway to the second end of the housing. The entrance and exit slits define generally semicylindrical housing portions. The housing includes a handle portion beyond the terminus of the entrance and exit slitsfor the user to grasp the sisssors by. A first cutting edge is formed along one side of the entrance slit.

The semitubular rotary cutting blade is rotatably mounted within the housing and nominally retracted out of registry with the housing entrance and exit slits. The cutting blade includes a longitudinal inwardly beveled second cutting edge that is normally disposed adjacent the side of the housing entrance slit opposite the first cutting edge. Preferably, the second cutting edge is tapered toward the open end of the housing so that the cutting edge spirals about the longitudinal axis of the housing. As a result of this spiral tapering, the second cutting edge moves progressively past the first cutting edge when the rotary blade is rotated from its retracted position.

In one more specific aspect of the present invention, the rotation of the cutting member may be affected by a spiral groove formed across its outer surface. A guide pin projects inwardly from the housing and is slidably disposed within the groove, constraining the rotary blade to rotate as it is slidably advanced and retracted within the housing.

In a further more specific aspect of the present invention, a push rod is swivelably secured to the end of the rotary blade closest to the second end of the housing, and projects outwardly from the housing through an opening formed in the handle portion of the housing. The outwardly projecting end of the push rod is pivotally secured to the underside of a hatch lever that is in turn pivotally secured to the housing adjacent the opening. The hatch lever may be depressed towards the housing to advance the push rod and, thus, the rotary blade within the housing, causing the rotary blade to rotate through the progress of a cut. The hatch lever covers the opening in the housing when fully depressed, where the hatch lever may be secured by a slidable locking mechanism.

BRIEF DESCRIPTION OF THE DRAWINGS

The present invention will be readily understood by those of ordinary skill in the art, upon reading the following specification in conjunction with the appended drawings, in which.

DETAILED DESCRIPTION OF THE PREFERRED EMBODIMENTS

Figure 1:
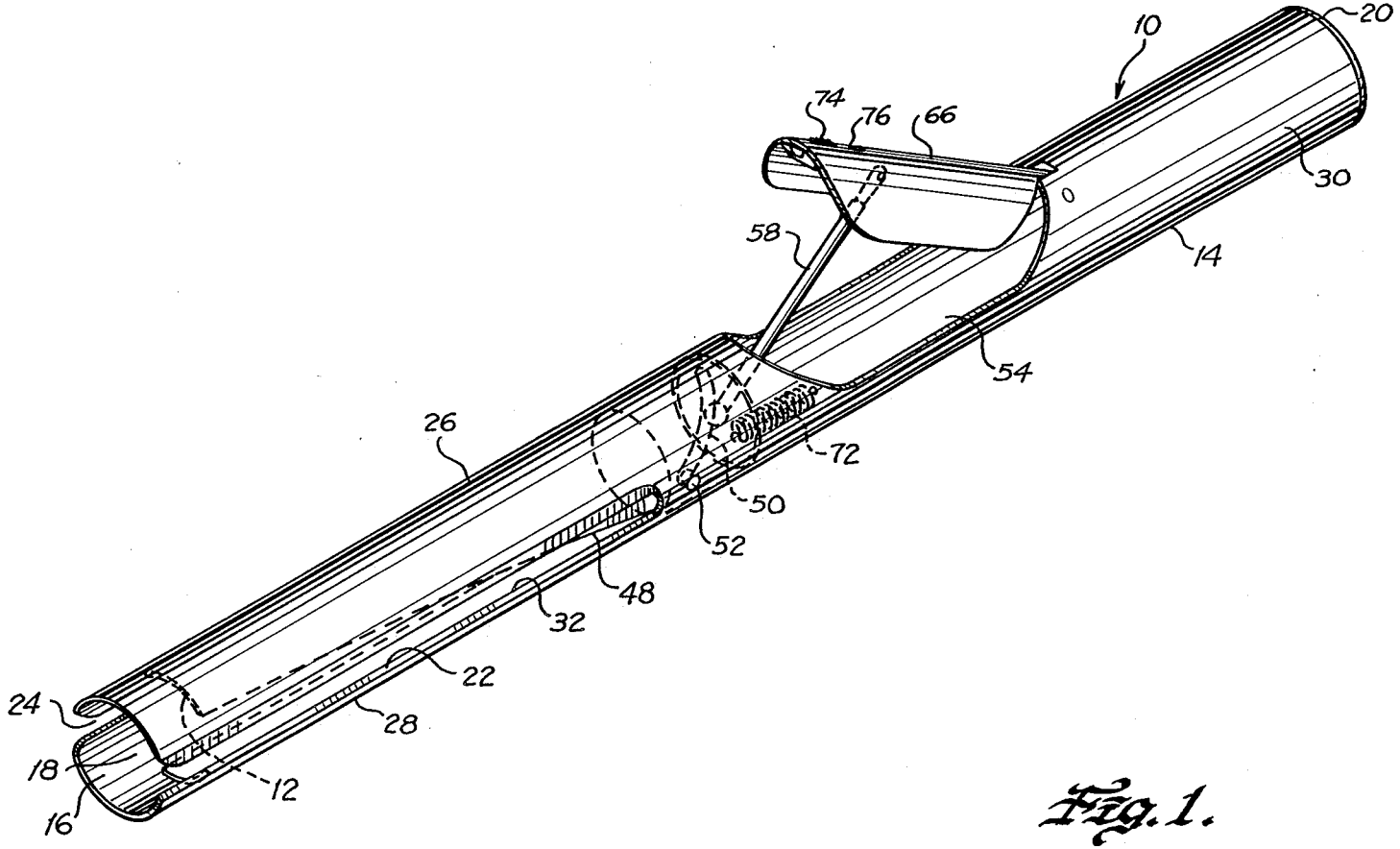
FIG. 1 shows a front pictorial view of the present invention in the form of a hand-held rotary blade scissors.
Figures 2, 3, 4, 5:
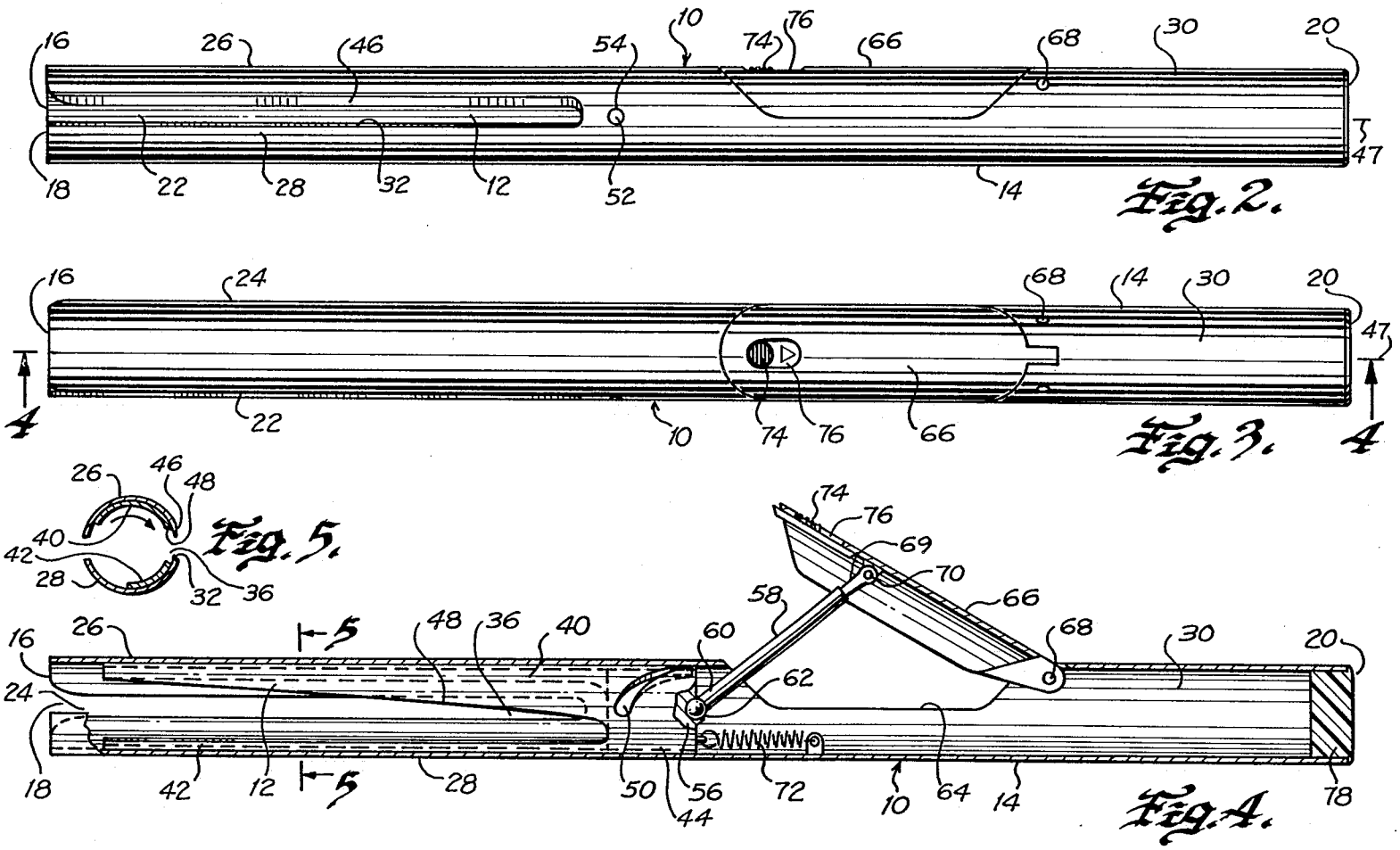
FIG. 2 is a side elevation view of the rotary blade scissors with the hatch lever depressed and locked.
FIG. 3 is a top elevation view of the rotary blade scissors as configured in FIG. 2.
FIG. 4 is a side cross-sectional view taken substantially along lines 4—4 of FIG. 3 showing the hatch lever in an open position and the cutting blade in its retracted position.
FIG. 5 is a cross-sectional view taken along lines 5—5 of FIG. 4 of the rotary blade scissors as configured in FIG. 4.

The present invention is suitable for utilization as a hand-held scissors or as a stationary cutting device, such as a tabletop cutter. FIG. 1 illustrates a preferred embodiment of the present invention integrated into a hand-held scissors 10. The scissors 10 includes a semitubular rotary cutting blade 12 that is rotatably and slidably mounted within a tubular housing 14. The tubular housing 14 defines an open first end 16 connected by an internal cylindrical cavity 18 to a second end 20. An entrance slit 22 and diametrically opposed exit slit 24 extend from the open first end 16 longitudinally toward the second end 20, defining an upper housing portion 26, a lower housing portion 28 and a handle portion 30 extending between the terminus of slits 22 and 24 and the second end 20 of the housing. The entrance slit 22 has a first side or lip adjacent the lower portion 28 along which is formed an outwardly beveled first cutting edge 32, as can be seen in FIGS. 2 and 3.

The tubular housing 14 can be constructed of any suitably rigid material, such as stainless steel, aluminum, or thermoplastic resin. If constructed of a material such as stainless steel that is capable of holding a sharp knife edge, as is preferable, the first cutting edge 32 is integral with the housing 14, as illustrated. If constructed of a material unsuitable for holding a knife edge, such as some thermoplastic resins, a separate first cutting edge could alternately be mounted along the first side of the entrance slit.

Although the housing 14 is illustrated as generally tubular in shape, other configurations, such as a parallelpiped block, are possible so long as the internal cavity 18 is of a cylindrical shape.

Ideally, the outer diameter of the rotary blade 12 closely matches and is slightly smaller than the internal diameter of the cavity 18. Also, ideally the rotary blade in cross section extends along an arc of at least 180 degrees so as to automatically center itself within the cavity 18. Further, ideally the rotary blade 12 includes an elongated slit 36 extending from the open first end 16 of the housing 14 for a length generally corresponding to that of the entrance and exit slits 22 and 24 of the housing. As shown in FIG. 4, the slit 36 roughly bisects the rotary blade 12 into a cutting portion 40 and a stabilizing portion 42, each of which has an arc-shaped cross section, and a cylindrical mounting portion 44 extending from the terminus of the slit 36 toward the second end 20 of the housing 14.

Referring again specifically to FIG. 4, the slit 36 is configured so that when the rotary blade 12 is in its retracted position, the cutting portion 40 is nested within upper portion 26 of the housing adjacent the second side 48 of the housing entrance slit 22, and its stabilizing portion 42 is nested within lower housing portion 28. When in this retracted position, the slit 36 of the rotary blade 12 is aligned with the housing entrance slit 22.

The cutting portion 40 of the rotary blade 12 includes an inwardly beveled second cutting edge 48 formed along the slit 36 as shown in the cross-sectional illustration of FIG. 5. The second cutting edge 48 tapered along the cutting portion from the mounting portion 44 toward the open first end 16 of the housing 14, with the arcuate length in cross section of the cutting portion 40 decreasing towards the open first end 16. This taper results in the second cutting edge 48 spiraling slightly around the longitudinal axis 47 of the tubular housing 14. It will be appreciated that the cutting edge 48 is exposed only at the entrance slit 22, the scissors 10 are relatively safe, making it unlikely that a user's fingers would be accidentally cut.

In a preferred configuration of the present invention, the rotary blade 12 is constructed from a single length of tubing or initially flat material formed into an arcuate cross-sectional shape. However, it should be understood that the rotary cutting blade could alternately be formed by securing separate cutting and stabilizing members to an annular mounting member.

The rotary blade 12 may be composed of any rigid material suitable of being formed into a thin blade, such as stainless steel or aluminum.

When the rotary blade 12 is retracted, as illustrated in FIG. 4, a web of material may be inserted through the housing entrance slit 22 and perhaps also through the housing exit slit 24. The rotary blade 12 may then be rotated from its retracted position to progressively move the second cutting edge 48 past the first cutting edge 32 to cut the web therebetween. When the second cutting edge 48 has moved completely past the first cutting edge 32, the cutting portion 40 occludes the entrance slit 22, as shown in FIG. 2. The rotary blade 12 is configured to prevent occlusion of the housing exit slit 24 even when the rotary blade is rotated from its retracted position, allowing for free withdrawal of the cut web. The stabilizing portion 42 of the blade 12 acts to maintain the longitudinal alignment of the cutting portion 40 within cavity 18 as the rotary blade is moved through the cut.

Referring again to FIG. 4, details of the mechanism for rotatably advancing and retracting the rotary blade 12 within the housing 14 can be seen. A groove 50 is formed within the outer surface of the rotary blade mounting portion 44 adjacent the blade cutting portion 40. The groove 50 is formed to spiral around the longitudinal axis 47 of the housing 14. A transverse guide pin 52 is secured within a cross hole 54 formed within the housing handle portion 30 adjacent the terminus of the housing entrance slit 22. The guide pin 52 projects transversely inwardly to slidably engage within the groove 50. The interaction of the guide pin 52 and the groove 50 constrains the rotary blade 12 so that it rotates from its retracted position (shown in solid line in FIG. 4) as the rotary blade 12 is advanced along the longitudinal axis of the housing 14 toward the open first end 16. Similarly, the rotary blade 12 is constrained to return to its retracted position when the rotary blade is retracted along the longitudinal axis of housing 14.

Preferably, a solid cylindrical plug 56 is secured within the mounting portion 44 of rotary blade 12 to provide structural rigidity to the blade 12 and also to serve as a convenient connection member with an elongated push rod 58 used to advance and thus rotate the cutting blade. The push rod 58 has a first or forward end 60 swivelably secured by a ball joint 62 to the center portion of the cylindrical plug 56 in proximity to the housing handle portion 30. The push rod 58 is capable of projecting outwardly through a lateral opening 64 formed within the housing handle portion 30 in registry with the upper housing portion 26.

Referring still to FIG. 4, a hatch lever 66 is pivotally secured by a cross pin 68 to the housing handle portion 30 adjacent the end of the lateral opening 64 closest to the second or rear housing end 20. The hatch lever 64 is capable of projecting laterally outwardly from the housing 14, and is depressible to cover the lateral opening 64. When fully depressed, as shown in FIGS. 2 and 3, ideally the outer contour of the hatch lever 66 blends smoothly with that of the housing 14.

The second or rear end 69 of the push rod 58 is rotatably secured to the underside of the hatch lever 66 by a transverse pivot pin 70 at a location spaced forwardly from the pivotal attachment of the hatch lever 66 to the housing 14 by the pin 68. Thus, depressing the hatch lever 66 to cover the lateral opening 64 pushes the push rod 58 forwardly to longitudinally advance the rotary blade 12, with the cylindrical plug 56 swiveling about the forward end 60 of the push rod 58 at the ball joint 62. This advancement of the rotary blade 12 causes it to simultaneously rotate due to the interaction of the guide pin 52 and the groove 50, resulting in the cutting of a web inserted into the scissors 10. The leverage provided by hatch lever 66 reduces the amount of force required to advance the rotary blade 12 through a cutting cycle.

An extension spring 72 has a first end secured to the cylindrical plug 56 and a second end secured to the inside of the housing handle portion 30, and acts to bias the rotary blade 12 to its retracted position. When a user releases pressure on the depressed hatch lever 66, the coil spring 72 automatically returns the cutting blade 12 to its retracted position in preparation for another cut for ease in cutting long sections of webbing. When not in use, hatch lever 66 may be locked in the depressed configuration by sliding a locking button 74, mounted through a locking slot 76 formed in the forward end portion of the hatch lever 66, towards the housing first end 16, to engage the button 74 under the edge of the housing handle portion 30 adjacent the lateral opening 64. Sliding the locking button 74 in the opposite, rearward direction results in the release of the hatch lever 66.

Ideally, a cylindrical end cap 78 is inserted within the second housing end 20 to prevent dirt, or debris, etc. from entering tubular housing 14.

As an alternative to the use of a biasing spring, loop-shaped finger grips, not shown, such as those utilized in conventional hand-held scissors, could be mounted on the rotary blade scissors 10. One finger grip could be secured to the outer surface of hatch lever 66 and a second diametrically opposed finger grip secured to the outer surface of the housing handle portion 30. This would enable the present invention to be operated with the typical squeezing force used to operate conventional scissors.

It should also be apparent that instead of utilizing the hatch lever and push rod configuration of the preferred embodiment, other mechanisms for causing the rotary cutting blade 12 to advance and retract along the longitudinal axis of tubular housing 14 may be utilized. One example of an alternative mechanism would be a spring-biased plunger, not shown, mounted longitudinally within the rear end of the housing to contact the cylindrical plug secured to the rotary blade. The longitudinal axis of the plunger would be aligned with the longitudinal axis of the housing, and would be activated by gripping finger flanges, not shown, provided on the outside of the housing handle, and depressing the plunger, much as one would activate a syringe.

Another example would involve the provision of an air-tight fit between the mounting portion of the cutting blade and the housing cavity, and the adaptation of a rubber bulb, not shown, or other type of air bladder to the second housing end. Squeezing the bulb would force air into the housing to advance the rotary blade 12 due to the air pressure exerted on the cylindrical plug that is secured inside the rotary blade.

As an alternative to the use of the spiral groove 50 and guide pin 52, and the hatch lever 66 and push rod 58, for spiral rotation of the rotary blade, the present invention could be embodied with alternate mechanisms for the axial rotation of the rotary blade 12. An example of this would be the adaptation of a lever, not shown, that is secured to the rotary blade and projects radially outwardly through a radial opening created in the housing. Squeezing the lever towards a stop projection, not shown, formed on the outside of the housing adjacent the radial opening would result in rotation of the rotary blade. Loop-shaped finger grips could also be secured to the lever and the stop projection for ease of handling.

One of ordinary skill, after reading the foregoing specification, will be able to effect various other changes, alterations and substitutions of equivalents without departing from the broad concepts disclosed. It is therefore intended that the scope of Letters Patent granted hereon be limited only by the definition contained in the appended claims and the equivalents thereof.

The embodiments of the invention in which an exclusive property or privilege is claimed are defined as follows:

1. A device for cutting a web, said device comprising:

a housing forming an elongated cylindrical cavity, the housing having an entrance slit for receiving the web therein, the entrance slit extending from an open first end of the cavity longitudinally towards a second end of the cavity;

a first cutting edge formed along the housing at a first side of the entrance slit;

an elongated cutting member mounted within the cavity, the cutting member having a second cutting edge nominally disposed adjacent at least a portion of a second side of the entrance slit of the housing opposite the first cutting edge; and means operably connected to the cutting member for rotating the cutting member relative to the entrance slit from a retracted position, in which a majority of the length of the second cutting edge is disposed adjacent the second side of the entrance slit, to move the second cutting edge across the entrance slit and closely past first cutting edge to cut the web disposed therebetween.

2. The cutting device of claim 1, wherein the cutting member has an arc-shaped cross section corresponding to the radius of the housing cavity.

3. The cutting device of claim 2, wherein the arcuate length of the cutting member tapers along the second cutting edge towards the first end of the cavity so that the second cutting edge spirals slightly about the longitudinal axis of the cavity, the second cutting edge moving gradually across the housing entrance slit and past the first cutting edge as the cutting member is rotated from its retracted position.

4. The cutting device of claim 3, wherein the housing includes an exit slit, generally diametrically opposed to the entrance slit, for the web to exit therefrom.

5. The cutting device of claim 4, further comprising an elongated stabilizing member mounted within the cavity and secured to the cutting member, the stabilizing member being spaced away from the cutting member around the circumference of the housing cavity, the stabilizing member and the cutting member being disposed on opposite sides of the entrance slit when the cutting member is in its retracted position.

6. The cutting device of claim 5, wherein the cutting member and the stabilizing member cooperatively define a generally tubular configuration having an outside diameter corresponding to the inside diameter of the housing cavity, the tubular configuration including an elongate first slit and a generally diametrically opposed, elongate second slit, the first slit and the second slit being generally aligned with the entrance slit and the exit slit, respectively, when the cutting member is in its retracted position.

7. The cutting device of claim 6, wherein the housing is generally tubular in configuration and the entrance and exit slits terminate at a point longitudinally spaced away from the second end of the housing cavity.

8. The device of claim 7, wherein:

the housing includes an opening extending through a portion of its circumference; and, the means for selectively rotating the cutting member comprises a lever secured to the cutting member and projecting outwardly through the housing opening, the lever being depressible to rotate the cutting member about the longitudinal axis of the cavity.

9. The cutting device of claim 1, wherein the means for selectively rotating the cutting member comprises:

means for advancing and retracting the cutting member along the longitudinal axis of the cavity; and means for constraining the cutting member to rotate about the longitudinal axis of the housing cavity during advancement and retraction of the cutting member within the housing.

10. The cutting device of claim 9, wherein the means for constraining the cutting member to rotate comprises:

a groove formed in the cutting member that spirals about the longitudinal axis of the cavity; and guide pin means protruding radially inwardly from the housing and slidably disposed within the groove to constrain the cutting member to rotate as the cutting member is longitudinally advanced and retracted.

11. The cutting device of claim 10, wherein the means for advancing and retracting the cutting member comprises:

a lever member having a first end pivotally secured to the housing, the lever member being extendable outwardly from the housing; and a push rod having a first end swivelably secured to the cutting member and a second end projectible outwardly through a lateral opening in the housing, the second end of the push rod being pivotally secured to the lever member, the lever member being depressible to advance the push rod and thus advance the cutting member along the longitudinal axis of the cavity, with the cutting member simultaneously swiveling about the first end of the push rod.

12. The cutting device of claim 11, further comprising means for biasing the cutting member towards its retracted position.

13. The cutting device of claim 12, wherein the means for biasing the cutting member comprises spring means with a first end secured to the cutting member and a second end secured to the housing.

14. The cutting device of claim 12, wherein the lever member comprises a hatch capable of covering the lateral opening in the housing when the lever is depressed.

15. The cutting device of claim 14, further comprising means for selectively locking the lever member when it is depressed.

* * * * *